US012539448B2

(12) United States Patent
Madson et al.

(10) Patent No.: US 12,539,448 B2
(45) Date of Patent: Feb. 3, 2026

(54) HEPTAGONAL DIPYRAMID DIMPLE PATTERN FOR A GOLF BALL

(71) Applicant: Acushnet Company, Fairhaven, MA (US)

(72) Inventors: Michael R. Madson, Easton, MA (US); Nicholas M. Nardacci, Bristol, RI (US); Chris Hixenbaugh, North Dartmouth, MA (US)

(73) Assignee: Acushnet Company, Fairhaven, MA (US)

( * ) Notice: Subject to any disclaimer, the term of this patent is extended or adjusted under 35 U.S.C. 154(b) by 112 days.

(21) Appl. No.: 17/719,512

(22) Filed: Apr. 13, 2022

(65) Prior Publication Data

US 2023/0330492 A1 Oct. 19, 2023

(51) Int. Cl.
*A63B 37/14* (2006.01)
*A63B 37/00* (2006.01)

(52) U.S. Cl.
CPC .... *A63B 37/00065* (2020.08); *A63B 37/0016* (2013.01); *A63B 37/002* (2013.01); *A63B 37/0021* (2013.01)

(58) Field of Classification Search
CPC ..... A63B 37/0004–00215
See application file for complete search history.

(56) References Cited

U.S. PATENT DOCUMENTS 5,090,705 A * 2/1992 Oka ..... A63B 37/008 473/384
5,259,624 A * 11/1993 Puckett ..... A63B 37/0004 473/383
5,759,116 A * 6/1998 Kasasima ..... A63B 37/002 425/116
7,503,856 B2 * 3/2009 Nardacci ..... A63B 37/0004 473/383
7,635,313 B2 * 12/2009 Isogawa ..... A63B 37/0021 473/383
9,566,473 B2 * 2/2017 Madson ..... A63B 37/00065
9,975,004 B2 * 5/2018 Sajima ..... A63B 37/002
10,183,195 B2 * 1/2019 Madson ..... A63B 37/0004
10,398,941 B2 * 9/2019 Madson ..... A63B 37/00065
10,758,783 B1 * 9/2020 Madson ..... A63B 37/0012
10,814,179 B1 * 10/2020 Madson ..... A63B 37/002
10,933,283 B2 * 3/2021 Madson ..... A63B 1/00
11,045,692 B2 * 6/2021 Madson ..... A63B 37/0012
11,173,346 B2 * 11/2021 Madson ..... A63B 37/0007
11,406,876 B2 * 8/2022 Madson ..... A63B 37/002
2005/0137032 A1 * 6/2005 Aoyama ..... A63B 37/0004 473/378
2005/0201418 A1 * 9/2005 Aoyama ..... A63B 37/00065 370/480
2007/0026971 A1 * 2/2007 Aoyama ..... A63B 37/0004 473/378

(Continued)

*Primary Examiner* — Eugene L Kim
*Assistant Examiner* — Matthew B Stanczak
(74) *Attorney, Agent, or Firm* — Steven Landolfi, Jr.

(57) ABSTRACT

A golf ball has a generally spherical surface and a plurality of dimples formed on the surface. The dimples are arranged in a dimple pattern defined by a heptagonal dipyramid projected on the surface. The pattern includes fourteen substantially identical dimple sections including seven dimple sections in a first hemisphere and seven dimple sections in a second hemisphere.

16 Claims, 11 Drawing Sheets

(56) References Cited

U.S. PATENT DOCUMENTS

| | | | | |
|---|---|---|---|---|
| 2007/0049423 | A1* | 3/2007 | Nardacci | A63B 37/0021 473/378 |
| 2010/0190584 | A1* | 7/2010 | Sajima | A63B 37/0021 473/378 |
| 2013/0072325 | A1* | 3/2013 | Madson | A63B 37/00065 473/378 |
| 2018/0311533 | A1* | 11/2018 | Madson | A63B 37/002 |
| 2021/0093925 | A1* | 4/2021 | Madson | A63B 37/0012 |
| 2021/0093928 | A1* | 4/2021 | Madson | A63B 37/0008 |
| 2022/0161099 | A1* | 5/2022 | Madson | A63B 37/0006 |
| 2022/0176204 | A1* | 6/2022 | Madson | A63B 37/002 |
| 2022/0280839 | A1* | 9/2022 | Madson | A63B 37/0018 |

* cited by examiner

HEPTAGONAL DIPYRAMID DIMPLE PATTERN FOR A GOLF BALL

FIELD OF THE INVENTION

The present disclosure relates to golf ball dimple patterns, and, more particularly, golf ball dimple patterns that are defined by the projection of a heptagonal dipyramid onto a sphere.

BACKGROUND OF THE INVENTION

Historically, dimple patterns for golf balls have had an enormous variety of geometric shapes, patterns, and configurations. Primarily, patterns are laid out in order to provide desired performance characteristics based on the particular ball construction, material attributes, and player characteristics influencing the ball's initial launch angle and spin conditions. Therefore, pattern development is a secondary design step that is used to achieve the appropriate aerodynamic behavior, thereby tailoring ball flight characteristics and performance.

Aerodynamic forces generated by a ball in flight are a result of its velocity and spin. These forces, which overcome the force of gravity, are lift and drag. Lift force is perpendicular to the direction of flight and is a result of air velocity differences above and below the rotating ball. This phenomenon is attributed to Magnus and described by Bernoulli's Equation, a simplification of the first law of thermodynamics.

Bernoulli's equation relates pressure and velocity where pressure is inversely proportional to the square of velocity. The velocity differential, due to faster moving air on top and slower moving air on the bottom, results in lower air pressure on top and an upward directed force on the ball. Drag is opposite in sense to the direction of flight and orthogonal to lift. The drag force on a ball is attributed to parasitic drag forces, which consist of form or pressure drag and viscous or skin friction drag. A sphere is a bluff body, which is an inefficient aerodynamic shape. As a result, the accelerating flow field around the ball causes a large pressure differential with high-pressure forward and low-pressure behind the ball. In order to minimize pressure drag, dimples provide a means to energize the flow field and delay the separation of flow, or reduce the low-pressure region behind the ball. However, the penalty for reducing pressure drag is skin friction. Skin friction is a viscous effect residing close to the surface of the ball within the boundary layer. The dimples provide an optimal amount of disturbance, triggering the laminar turbulent flow transition while maintaining a sufficiently thin boundary layer region for viscous drag to occur.

The United States Golf Association (U.S.G.A.) requires that golf balls have aerodynamic symmetry. Aerodynamic symmetry allows the ball to fly with a very small amount of variation no matter how the golf ball is placed on the tee or ground. Preferably, dimples cover the maximum surface area of the golf ball without detrimentally affecting the aerodynamic symmetry of the golf ball.

Many dimple patterns are based on geometric shapes. These may include circles, hexagons, triangles, and the like. Other dimple patterns are based in general on three of five existing Platonic Solids including Icosahedron, Dodecahedron, or Octahedron. Furthermore, other dimple patterns are based on hexagonal dipyramids. Because the number of symmetric solid plane systems is limited, it is difficult to devise new symmetric patterns. Moreover, dimple patterns based some of these geometric shapes result in less than optimal surface coverage and other disadvantageous dimple arrangements. Therefore, dimple properties such as number, shape, size, and arrangement are often manipulated in an attempt to generate a golf ball that has better aerodynamic properties. Thus, there is a continuing need for novel dimple patterns incorporating unique combinations of dimple properties such as size, shape, number, volume, or arrangement, in order to provide a golf ball that has distinctive characteristics.

SUMMARY OF THE INVENTION

The present disclosure describes a golf ball including a plurality of dimples. The dimples may be arranged in a dimple pattern defined by a heptagonal dipyramid projected on a spherical outer surface of the golf ball. The pattern includes fourteen substantially identical dimple sections including seven dimple sections in a first hemisphere and seven dimple sections in a second hemisphere.

In other aspects, the present disclosure further describes the dimple sections that make up the dimple pattern. A boundary of each of the dimple sections may consist of two linear side edges and a linear or non-linear base edge. The side edges are defined such that each dimple section consists of a plurality of shared non-polar dimples each of which has a centroid that lies on a side edge of the dimple section, a plurality of dimples that are not intersected by a side edge, and, optionally, a shared polar dimple having a centroid that lies at the vertex of the two linear side edges of the section.

In another aspect, the present disclosure further describes exemplary dimples that make up the dimple sections and overall dimple pattern. For example, dimples having a polar angle of greater than or equal to 2° and less than or equal to 20° may have a planar area satisfying the following condition for a given polar angle x:

$$1.2\times10^{-4}x^2+2\times10^{-4}x\leq\text{planar area}\leq4.3\times10^{-4}x-7.5\times10^{-4}\text{ where }2^\circ\leq x\leq20^\circ.$$

In another example, the dimple pattern may include 370-390 dimples and provide surface coverage greater than 75% on the outer surface of the golf ball. Each dimple may have a diameter of 0.110 inches or greater. Each of the dimple sections may comprise at least five different dimple diameters. The centroids of at least three dimples may lie on each side edge of each dimple section. The dimple pattern within each dimple section may have mirror symmetry across a symmetry line that extends from an intersection of the two side edges to a midpoint of the base edge. The centroids of at least six non-polar dimples may lie on either (i) every symmetry line of every dimple section, or (ii) every side edge of every dimple section. The six (or more) non-polar dimples may include three dimples that lie closest to a vertex of the side edges that all have the same dimple diameter. The six (or more) non-polar dimples may include at least four different dimple diameters. The six (or more) non-polar dimples may include one dimple that lies closest to the base edge that has the smallest diameter of all of the dimples in the dimple section. The dimples within each dimple section that are located adjacent to the base edge of the section may have diameters that are different by 0.005 inches or less.

In another aspect of the present disclosure, a golf ball has two identical hemispheres connected at their bases to form the spherical shape. The dimple sections of the first hemisphere may be aligned with the dimple sections of the second hemisphere, or may be rotated with respect to the dimple sections of the second hemisphere. In some embodiments, some of the dimples of the first hemisphere may be interdigitated with some of the dimples of the second hemisphere to provide a staggered parting line. With a staggered parting line, the golf ball has no dimple-free great circles.

BRIEF DESCRIPTION OF THE DRAWINGS

The foregoing and other aspects of the present invention are best understood from the following detailed description when read in connection with the accompanying drawings. For the purpose of illustrating the invention, there are shown in the drawings embodiments that are presently preferred, it being understood, however, that the invention is not limited to the specific instrumentalities disclosed. Included in the drawings are the following Figures.

DETAILED DESCRIPTION OF THE INVENTION

Figure 1:
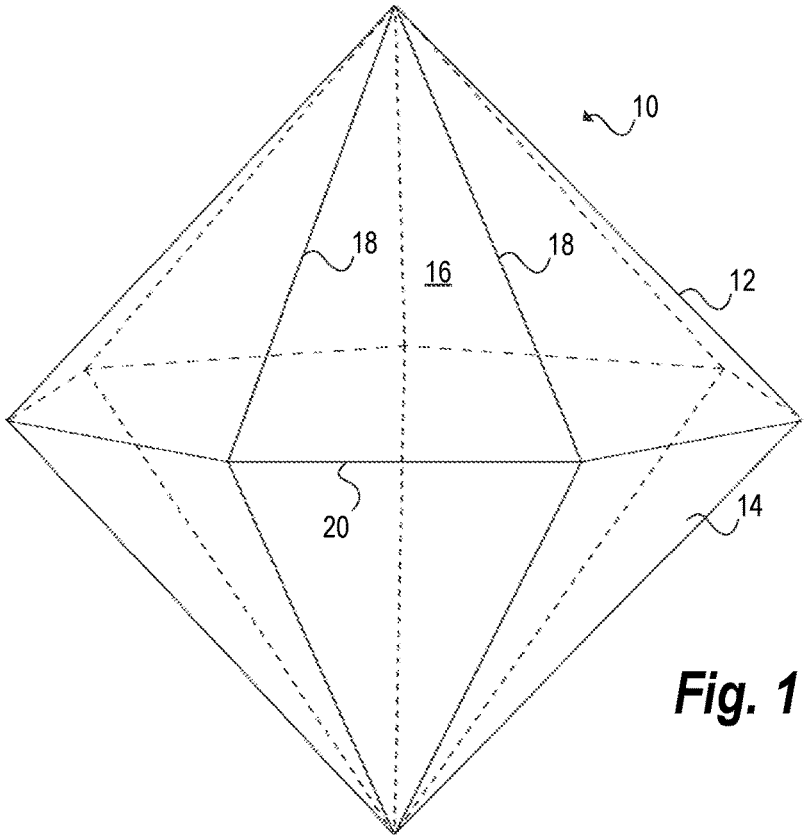
FIG. 1 is an example of a heptagonal dipyramid.

Disclosed embodiments include golf ball dimple patterns having multi-fold rotational symmetry around a polar axis of the golf ball. An exemplary embodiment uses the projected edges of a heptagonal pyramid as a means of arranging dimples on the surface of a hemisphere such that the hemisphere exhibits seven-fold rotational symmetry about the polar axis. The resulting rotationally-symmetrical dimple pattern may be applied to each of two hemispheres connected at an equatorial plane to create a dimple pattern for an entire spherical golf ball. The projected edges divide the dimple pattern into dimple sections, with each of the dimple sections being substantially identical. The edges that define the dimple sections are used to characterize the dimple pattern but are not physically present on the golf ball. The dimple pattern within each dimple section may be arranged to provide desired dimple surface coverage for the golf ball while maintaining the seven-fold rotational symmetry. In some embodiments, the dimple pattern of each dimple section may also exhibit mirror symmetry across a line within the boundaries of the dimple section.

As a result of basing the boundary lines on a heptagonal pyramid, the dimple sections each include two side edges and a base edge, similar to the edges of the triangular faces of the corresponding pyramid. For example, dimple sections may consist of two linear side edges and a linear or non-linear base edge. The two linear side edges of the dimple sections correspond to the linear side edges of each face of the dipyramid. Each side edge runs longitudinally from a base edge to the pole of a hemisphere. As discussed further below, the side edges may intersect one or more dimples. The base edges of the dimple sections are defined such that the base edges do not intersect any dimples. For example, the side edges may be defined such that each dimple section consists of a plurality of shared non-polar dimples each of which has a centroid that lies along a side edge of the dimple section, a plurality of dimples that are not intersected by a side edge, and, optionally, a shared polar dimple having a centroid that lies at the vertex of the two linear side edges of the dimple section. As used herein, a dimple centroid may be considered to lie on a line on a golf ball surface even though the centroid of the dimple technically lies in the empty volume defined by the dimple phantom surface. For the purposes of this disclosure, a dimple centroid is considered to lie on a line on a golf ball surface when the centroid is on a plane that also includes that line.

In one embodiment, the golf ball has a planar parting line wherein no dimples intersect the equatorial plane, and the base edges are straight lines corresponding to the linear base edges of the dipyramid on which the dimple pattern is based. In another embodiment, the golf ball has a non-planar parting line wherein at least a portion of the dimples located adjacent to the equator intersect the equatorial plane, and the base edges are curved segments drawn along the corresponding linear base edges of the dipyramid such that no dimples are intersected.

Dimples may be located entirely within a dimple section (i.e., the dimple perimeter is not intersected by a side edge or base edge) or dimples may be shared between two or more sections (also referred to herein as "shared dimples"). For every dimple that is not located entirely within a dimple section, the centroid of the dimple is located either at a hemispherical pole or on a side edge. Disclosed dimple patterns may include at least one dimple that lies on each of the side edges of the dimple sections. In some embodiments, the dimple pattern also includes at least one dimple that lies on a line of mirror symmetry of each dimple section (also referred to herein as a "symmetry line").

A heptagonal dipyramid is a polyhedron formed from two heptagonal pyramids joined at their bases. The resulting solid has fourteen triangular faces, nine vertices, and twenty-one edges. In FIG. 1, a heptagonal dipyramid 10 is formed from a first heptagonal pyramid 12 and a second heptagonal pyramid 14. Each of the fourteen triangular faces 16 has two side edges 18 and a base edge 20. Adjacent faces 16 share a side edge 18. The base edges 20 are connected around a centerline of the heptagonal dipyramid 10. In the disclosed figures, the reference numerals are included and point to examples of corresponding components, even though more are shown. The description of one feature that is repeated can be equally applied to the same features throughout the embodiment. For example, in the depicted embodiment, all of the faces 16 and edges 18 shown on the dipyramid 10 are the same or similar and thus are represented by face 16 and its side edges 18 and base edge 20.

Figure 2:
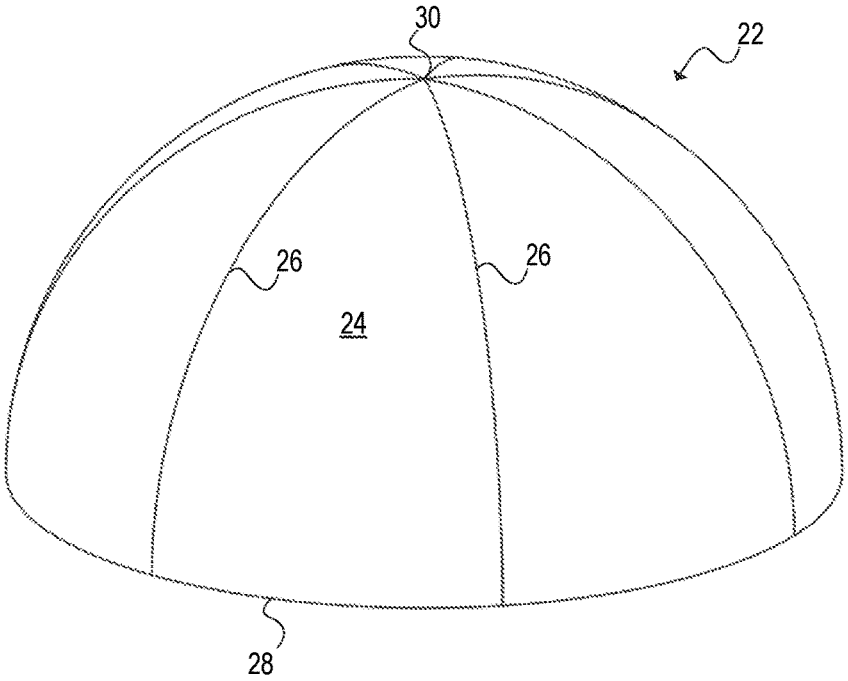
FIG. 2 illustrates a projection of a heptagonal pyramid on a hemisphere.

FIG. 2 is a hemisphere 22 including a projection of the edges 16, 18 of the first heptagonal pyramid 12 onto the outer surface of the hemisphere 22. The hemisphere 22 is thus divided into seven sections 24 by the projected edges. It should be understood that the projected edges are boundary lines (e.g., define a boundary) for dividing the hemisphere 22 into seven identical sections 24, but are not physical edges or otherwise present on the hemisphere 22. Each section 24 of the hemisphere 22 includes a boundary defined by two side edges 26 and a base edge 28. The two side edges 26 are straight lines corresponding to the linear side edges of the first heptagonal pyramid 12. The side edges 26 and other similar edges disclosed herein are considered to be "linear" for the purposes of this disclosure, as they follow a straight path on the surface of the golf ball (i.e., a longitudinal or latitudinal line on the golf ball). For example, each side edge 26 runs longitudinally from the base edge 28 to a pole 30 of the hemisphere 22.

Figure 3A:
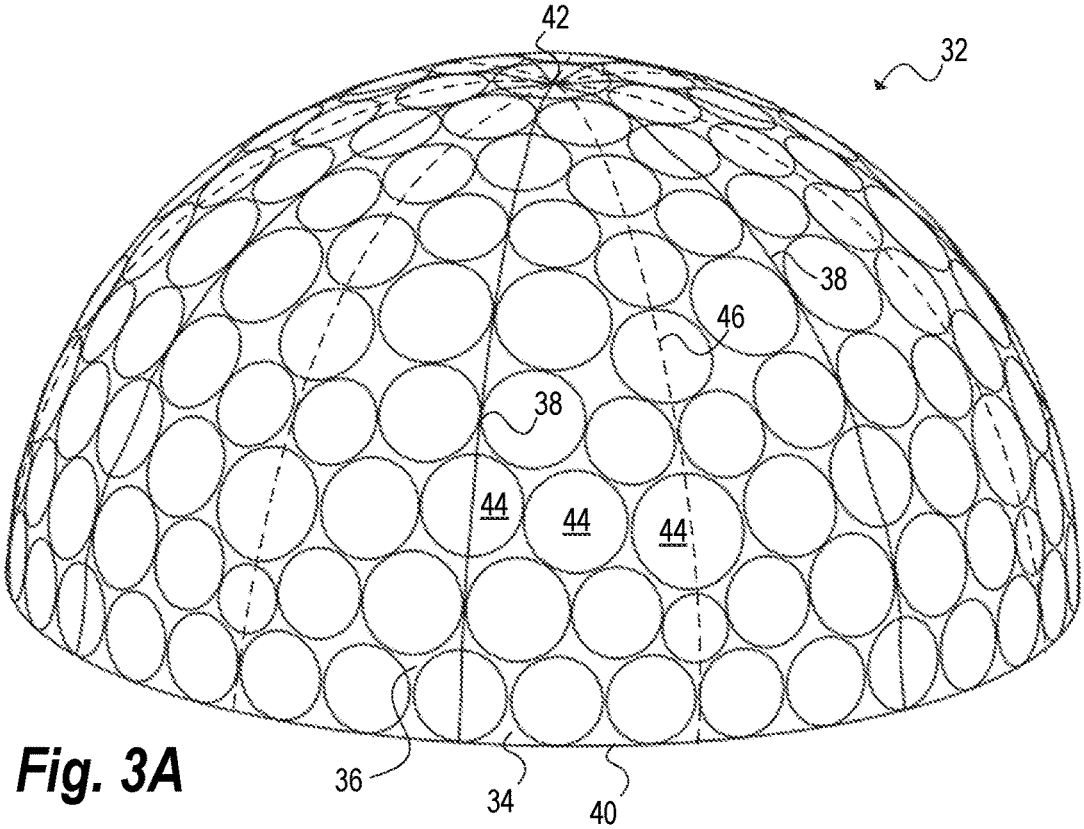
FIG. 3A illustrates an exemplary dimple pattern on the hemisphere of FIG. 2, and exemplary boundary lines separating the dimple pattern into dimple sections.

FIG. 3A is a hemisphere 32 including projected edges that define a boundary dividing the hemisphere 32 into seven dimple sections 34, much like the hemisphere 22. The hemisphere 32 has generally spherical outer surface 36. The boundary of each dimple section 34 includes side edges 38 and base edges 40. The side edges 38 intersect at a vertex at the pole 42 of the hemisphere 32. Each dimple section 34 is defined by two side edges 38 and the base edge 40 that connects the two side edges 38 to each other.

The hemisphere 32 additionally includes a plurality of dimples 44 formed on the surface 36. The plurality of dimples 44 include all of the dimples on the surface 36 of the hemisphere 32, of which only three include reference numerals. The plurality of dimples 44 are arranged in a dimple pattern. The plurality of dimples may 44 may include a polar dimple with a centroid at the pole 42. The dimples 44 that do not lie at the pole 42 may be considered non-polar dimples. Some of the dimples 44 may lie on the side edges 38 and as such are shared dimples between two dimple sections 34. More particularly, the centroid of some dimples 44 lie on a plane that includes the side edge 38, and thus may be considered to lie on the side edge 38 in accordance with the present disclosure. The dimple pattern is arranged such that each of the seven dimple sections 34 are substantially identical. The dimples 44 are configured such that the projected area of each dimple plan shape is within an appropriate design range in order to accommodate the seven-fold symmetry and provide desirable aerodynamic performance. For example, the dimple planar area may be dependent on one or more of the volume of the dimple or the location of the dimple on the golf ball.

In FIG. 3A, the dimples 44 are arranged such that a pattern is repeated around the hemisphere 32 seven times, resulting in the seven substantially identical dimple sections 34. The dimple sections 34 in the depicted embodiment include mirror symmetry across a line of symmetry 46. More particularly, a plane of mirror symmetry divides each dimple section 34 in half and the line of symmetry 46 is a line on the surface 36 where the plane of mirror symmetry intersects the surface 36. The lines of symmetry 46 extend longitudinally from a vertex at the pole 42 to the midpoint of each base edge 40. The lines of symmetry 46 intersect the centroid of some of the dimples 44. More particularly, the centroid of some dimples 44 lie on a line of symmetry 46 (i.e., the centroid of some dimples 11 lie on a plane of mirror symmetry that includes a line of symmetry 46).

Figure 3B:
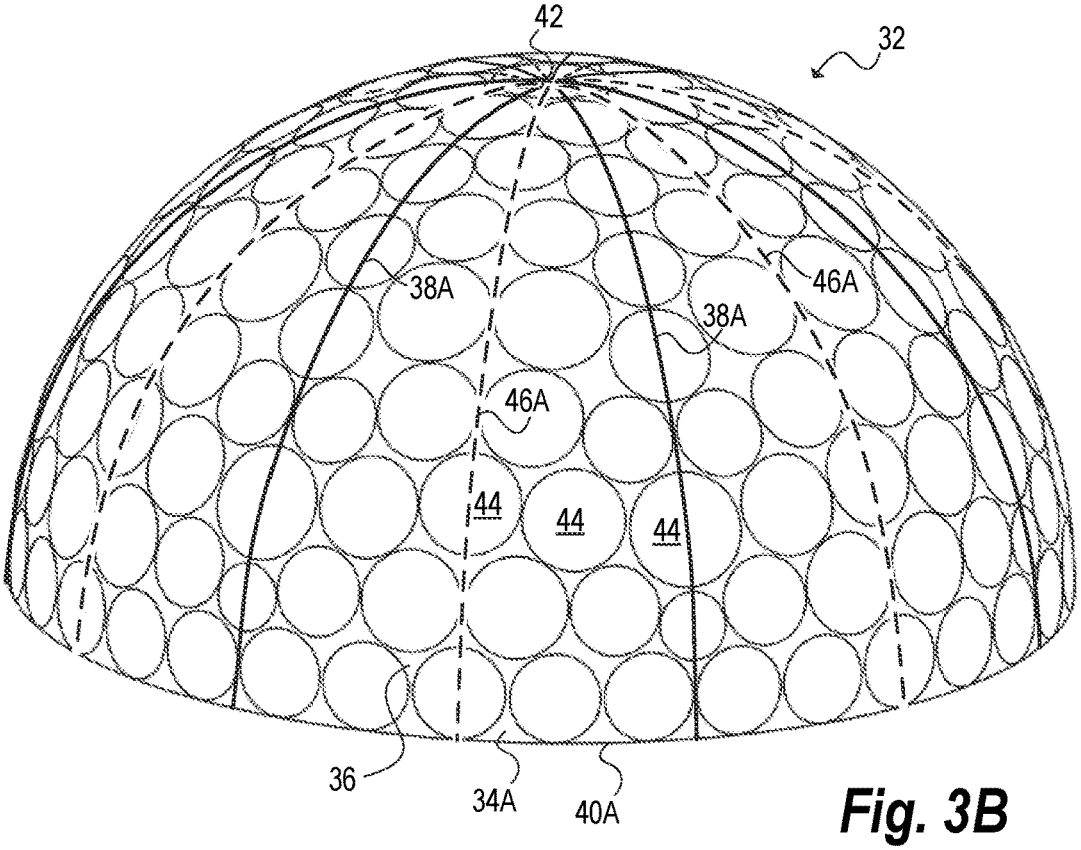
FIG. 3B illustrates the dimple pattern and hemisphere shown in FIG. 3A, together with an alternative boundary line layout.

The pattern of dimples 44 in the depicted embodiment is configured such that the there are two options for drawing the side edges 38 to create substantially identical dimple sections while maintaining the criteria that dimples 44 are either entirely within the boundaries of the dimple sections or have centroids that lie on the side edges 38 or on the pole 42. FIG. 3A depicts the first arrangement of side edges 38 (shown in solid lines), with the lines of symmetry 46 (shown in dashed lines) within dimple sections 34. FIG. 3B depicts the second arrangement in which the lines of symmetry 46 from FIG. 3A are considered side edges 38A (shown in solid lines) of dimple sections 34A and the side edges 38 from FIG. 3A are considered lines of symmetry 46A (shown in dashed lines). The base edges 40A are shifted relative to the base edges 40 in order to connect the side edges 38A. The dimples 44 are arranged in the exact same pattern in FIGS. 3A and 3B, with the only difference being the characterization of the dimple sections 34, 34A. The dimples 44 that lie on the side edges 38 in FIG. 3A lie on the lines of symmetry 46A in FIG. 3B. The dimples 44 that lie on the lines of symmetry 46 in FIG. 3A lie on the side edges 38 in FIG. 3B.

According to disclosed embodiments, the seven dimple sections (e.g., dimple sections 34, 34A) that make up the dimple pattern on each hemisphere are substantially identical to each other. In an exemplary embodiment of a spherical golf ball having two hemispheres, all fourteen dimple sections on the ball are substantially identical to each other. For purposes of the present disclosure, dimple sections are "substantially identical" if they have substantially the same dimple arrangement (i.e., the relative positions of their dimples' centroids are about the same) and substantially the same dimple characteristics (e.g., plan shape, cross-sectional shape, diameter, edge angle, etc.). Thus, for each dimple located entirely within a particular section on a hemisphere, there is a corresponding dimple in each of the other six dimple sections of that hemisphere. For dimples having a centroid located on a side edge, there is a corresponding dimple located on each of the other six side edges of that hemisphere. Dimples that are not located at the pole of a hemisphere may be considered non-polar dimples. Polar dimples, which may be, but are not necessarily present in dimple patterns of the present disclosure, are shared between all seven sections on a hemisphere, and, thus, have no corresponding dimple on that hemisphere. For each set of corresponding dimples, the relative positions of the dimple centroids within their respective sections are about the same, and each of the dimples within that set of corresponding dimples has substantially the same characteristics.

Figure 4:
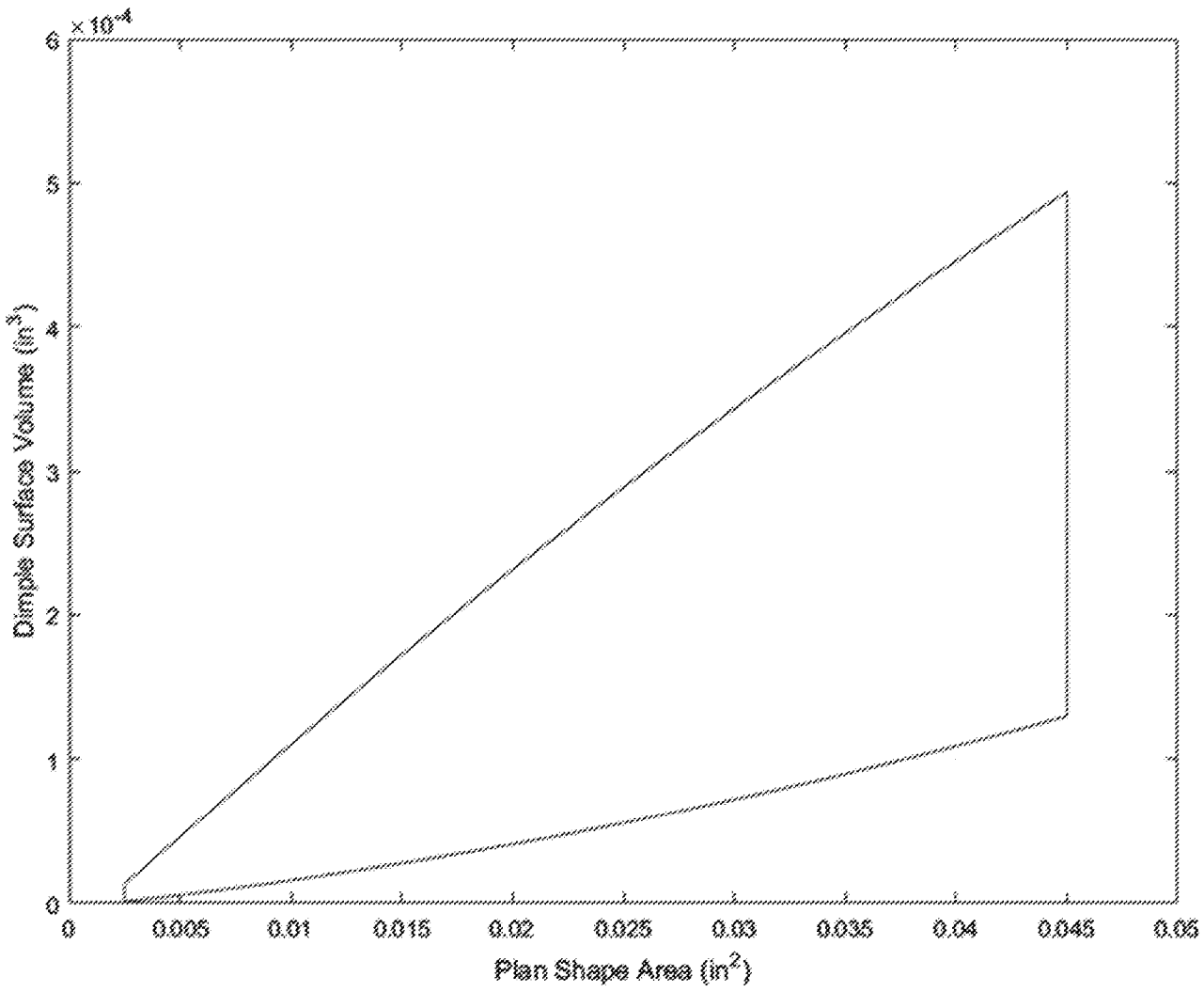
FIG. 4 is a graphical representation of the relationship between dimple volume and plan shape area.

Dimples of the present invention may have a variety of plan shapes, including, but not limited to, circular, polygonal, oval, or irregular shapes, and a variety of profile shapes, including, but not limited to, circular, catenary, elliptical, or conical shapes. Suitable non-spherical dimples preferably have a plan shape area and dimple volume within a range having a lower limit and an upper limit selected from the values within the region shown in FIG. 4, which is a graphical representation of the relationship between dimple volume and plan shape area of non-spherical dimples according to an embodiment of the present invention.

The plan shape area is based on a planer view of the dimple plan shape, such that the viewing plane is normal to an axis connecting the center of the ball to the point of the calculated surface depth. The dimple volume is the total volume encompassed by the dimple shape and the surface of the golf ball. The preferred dimple volume will be less than the upper limit volume calculated by $$V_s=-0.0464x^2+0.0135x-2.00\times10^{-5}$$

and greater than the lower limit calculated by $$V_s=0.0300x^2+0.0016x-3.00\times10^{-6}$$

where x is the dimple plan shape area and x is between 0.0025 and 0.045 inclusive.

For purposes of the present disclosure, the plan shape area of a non-spherical dimple is based on a planar view of the dimple plan shape, such that the viewing plane is normal to an axis connecting the center of the ball to the point of the calculated surface depth. The dimple volume is the total volume encompassed by the dimple shape and the surface of the golf ball.

The diameter of a dimple having a non-circular plan shape is defined by its equivalent diameter, $d_e$, which calculated as:

$$d_e = 2\sqrt{\frac{A}{\pi}}$$

where A is the plan shape area of the dimple. Diameter measurements are determined on finished golf balls according to FIG. 5. Generally, it may be difficult to measure a dimple's diameter due to the indistinct nature of the boundary dividing the dimple from the ball's undisturbed land surface. Due to the effect of paint and/or the dimple design itself, the junction between the land surface and dimple may not be a sharp corner and is therefore indistinct. This can make the measurement of a dimple's diameter somewhat ambiguous. To resolve this problem, the diameter of a dimple 100 on a finished golf ball is measured according to the method shown in FIG. 5.

Figure 5:
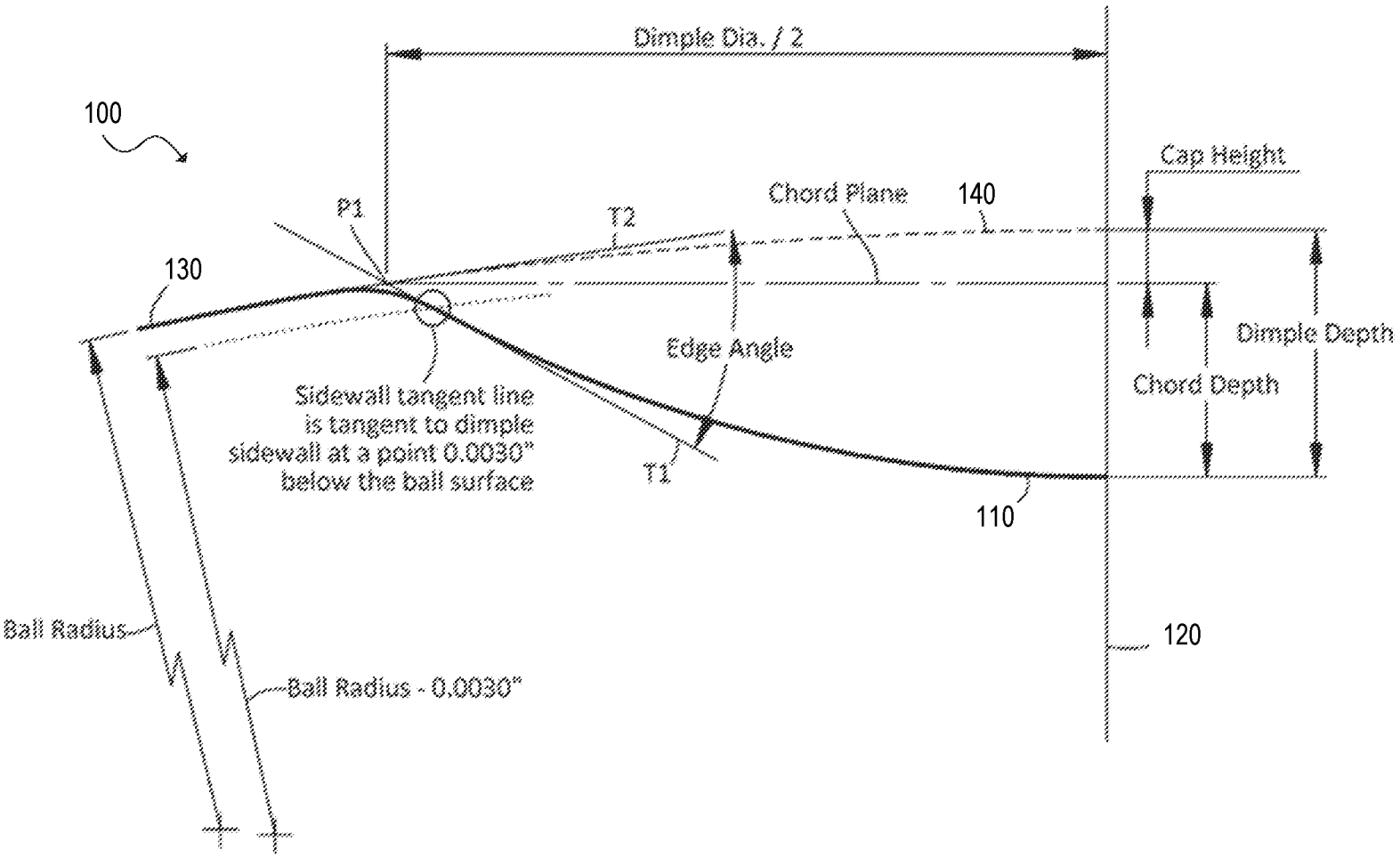
FIG. 5 is a schematic diagram illustrating a method for measuring the diameter of a dimple.

FIG. 5 shows a cross-sectional profile of a dimple surface 110 of the dimple 100, extending from the dimple centerline 120 to the land surface 130 outside of the dimple 100. A ball phantom surface 140 is constructed above the dimple 100 as a continuation of the land surface 130. A first tangent line T1 is then constructed at a point on the dimple sidewall that is spaced 0.003 inches radially inward from the phantom surface 140. T1 intersects phantom surface 140 at a point P1, which defines a nominal dimple edge position. A second tangent line T2 is then constructed, tangent to the phantom surface 140, at P1. The edge angle of the dimple 100 is the angle between T1 and T2. The diameter of the dimple 100 is the distance between P1 and its equivalent point diametrically opposite along the dimple perimeter. Alternatively, the dimple diameter is twice the distance between P1 and the dimple centerline 120, measured in a direction perpendicular to centerline 120. The depth of the dimple 100 is the distance measured along a ball radius from the phantom surface 140 of the ball to the deepest point on the dimple 100. The volume of the dimple 100 is the space enclosed between the phantom surface 140 and the dimple surface 110 (extended along T1 until it intersects the phantom surface).

In an exemplary embodiment, a majority of the dimples on the outer surface of golf balls of the present disclosure are spherical dimples, i.e., dimples having a circular plan shape and a profile shape based on a spherical function. In a particular aspect of this embodiment, the spherical dimples have one or more properties/characteristics selected from:

a) the edge angle of each spherical dimple is 10 or 11 or 12 or 13 or 14 or 15 or 16 degrees, or is within a range having a lower limit and an upper limit selected from these values;

b) the maximum difference in edge angle between any two of the spherical dimples is 1 degree;

c) the edge angle of all of the spherical dimples is substantially the same (For purposes of the present disclosure, edge angles on a finished ball are substantially the same if they differ by less than 0.25 degrees.); and d) the average edge angle of the spherical dimples is from 12 to 15 degrees; and The dimples may include subsets of like dimples having the same diameter. It should be understood that manufacturing variances are to be taken into account when determining the number of different dimple diameters. For purposes of the present disclosure, dimples having substantially the same diameter, also referred to herein as "same diameter" dimples, includes dimples on a finished ball having respective diameters that differ by less than 0.005 inches due to manufacturing variances.

The total number of dimples on the golf ball may also be varied according to the present embodiments. The total number of dimples may be based on, for example, the number of differently sized dimples, the maximum and minimum diameters of the dimples, the dimple arrangement, and the like. In an exemplary, the total number of dimples is between about 250 and about 500. In a more particular embodiment, the total number of dimples is between about 300-450 dimples. In another embodiment, the total number of dimples is between about 350-400 dimples. In a more particular embodiment, the total number of dimples is between about 370-390 dimples. In a particular embodiment, the total number of dimples is 380. In other exemplary embodiments, the total number of dimples is 252 or 254 or 264 or 266 or 276 or 278 or 288 or 290 or 300 or 302 or 312 or 314 or 324 or 326 or 336 or 338 or 348 or 350 or 360 or 362 or 372 or 374 or 384 or 386 or 396 or 398 or 408 or 410 or 420 or 422 or the total number of dimples is within a range having a lower limit and an upper limit selected from these values.

Aerodynamic characteristics of golf balls of the present invention can be described by aerodynamic coefficient magnitude and aerodynamic force angle. Based on a dimple pattern generated according to the present invention, in one embodiment, the golf ball achieves an aerodynamic coefficient magnitude of from 0.25 to 0.32 and an aerodynamic force angle of from 30° to 38° at a Reynolds Number of 230000 and a spin ratio of 0.085. Based on a dimple pattern generated according to the present invention, in another embodiment, the golf ball achieves an aerodynamic coefficient magnitude of from 0.26 to 0.33 and an aerodynamic force angle of from 32° to 40° at a Reynolds Number of 180000 and a spin ratio of 0.101. Based on a dimple pattern generated according to the present invention, in another embodiment, the golf ball achieves an aerodynamic coefficient magnitude of from 0.27 to 0.37 and an aerodynamic force angle of from 35° to 44° at a Reynolds Number of 133000 and a spin ratio of 0.133. Based on a dimple pattern generated according to the present invention, in another embodiment, the golf ball achieves an aerodynamic coefficient magnitude of from 0.32 to 0.45 and an aerodynamic force angle of from 39° to 45° at a Reynolds Number of 89000 and a spin ratio of 0.183. For purposes of the present disclosure, aerodynamic coefficient magnitude ($C_{mag}$) is defined by $C_{mag}=(C_L^2+C_D^2)^{1/2}$ and aerodynamic force angle ($C_{angle}$) is defined by $C_{angle}=\tan^{-1}(C_L/C_D)$, where $C_L$ is a lift coefficient and $C_D$ is a drag coefficient. Aerodynamic characteristics of a golf ball, including aerodynamic coefficient magnitude and aerodynamic force angle, are disclosed, for example, in U.S. Pat. No. 6,729,976 to Bissonnette et al., the entire disclosure of which is hereby incorporated herein by reference. Aerodynamic coefficient magnitude and aerodynamic force angle values are calculated using the average lift and drag values obtained when 30 balls are tested in a random orientation. Reynolds number is an average value for the test and can vary by plus or minus 3%. Spin ratio is an average value for the test and can vary by plus or minus 5%.

Golf balls of the present disclosure are not limited by a particular golf ball construction. The golf ball may have any type of core, such as solid, liquid, wound, and the like, and may be a one-piece, two-piece, or multilayer ball. Each layer of the golf ball may be constructed from any suitable thermoset or thermoplastic material known to those of ordinary skill in the art. When desirable, the cover may be coated with any number of layers, such as a base coat, top coat, paint, or any other desired coating.

Figure 6B:
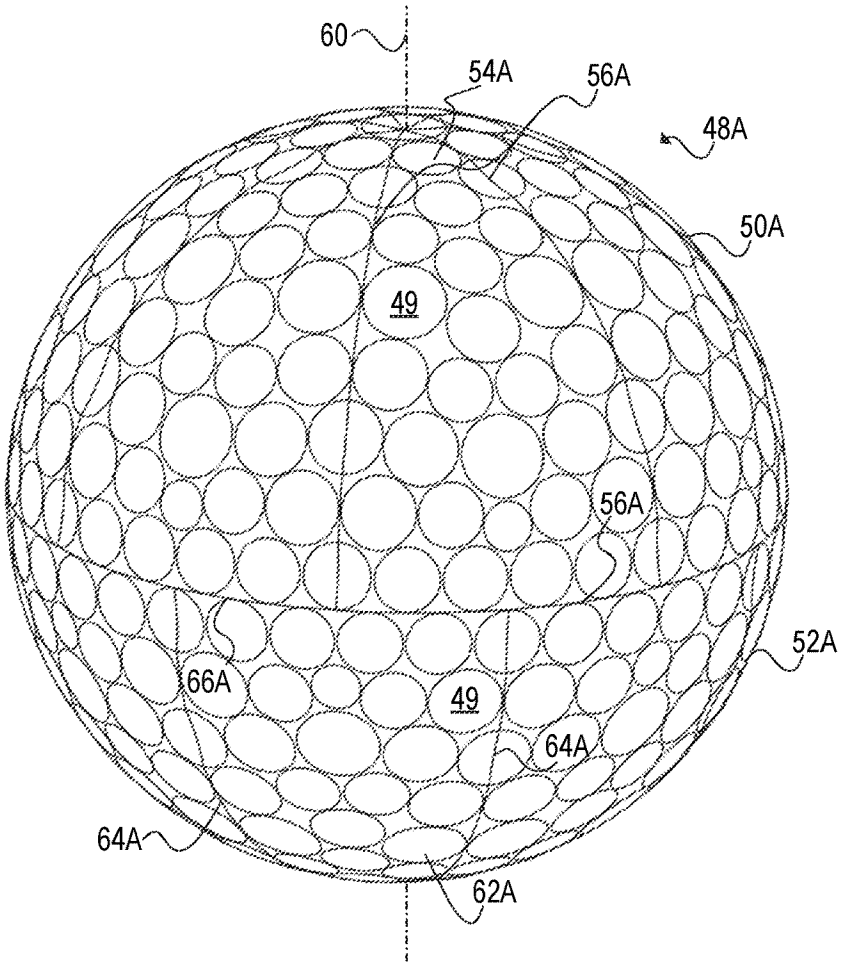
FIG. 6B illustrates a golf ball including a heptagonal dipyramid dimple pattern, according to a second embodiment.
Figure 6A:
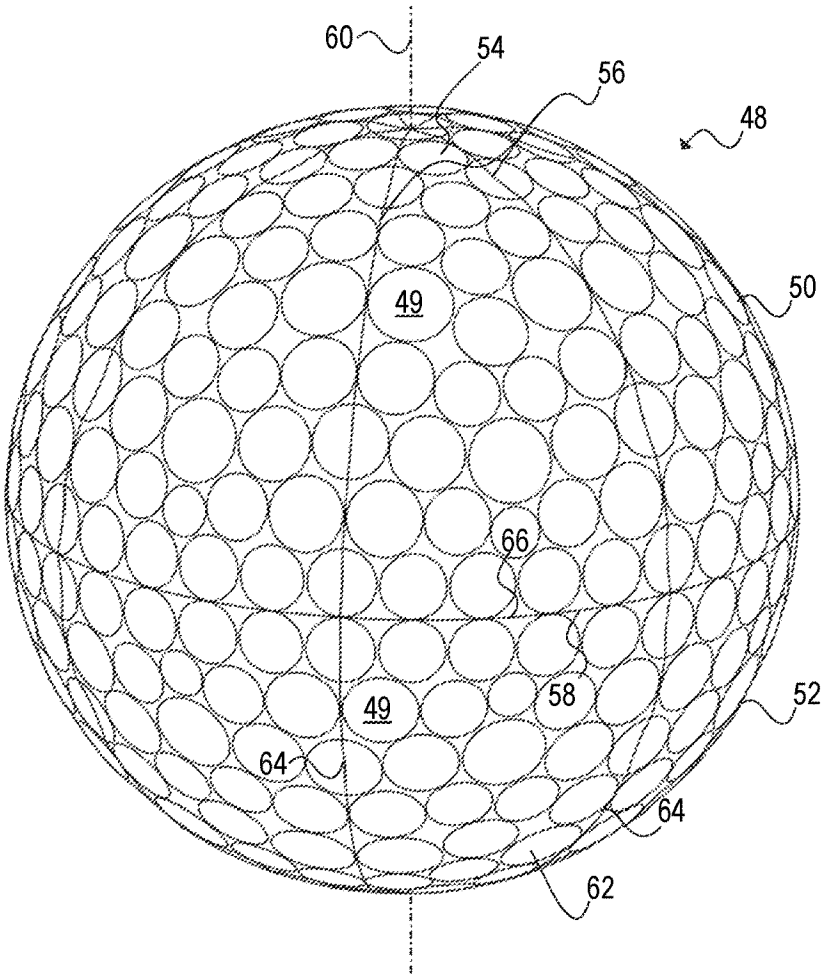
FIG. 6A illustrates a golf ball including a heptagonal dipyramid dimple pattern, according to a first embodiment.

FIG. 6A depicts a golf ball 48 having a plurality of dimples 49 in a dimple pattern based on a heptagonal dipyramid. The golf ball 48 is a generally spherical body having a first hemisphere 50 and a second hemisphere 52 connected at an equatorial plane. The first hemisphere 50 includes seven dimple sections 54, similar to or the same as the hemisphere 32 and dimple sections 34 in FIG. 3A. Each dimple section 54 includes a subset of the plurality of dimples 49, including some dimples that are shared with one or more other dimple sections 54. The dimple sections 54 include a boundary defined by side edges 56 and a base edge 58. It should be understood that the golf ball 48 is not physically divided into sections and that the side edges 56 and base edge 58 are boundaries that delineate the symmetry of the dimple pattern on the surface of the golf ball 48. The first hemisphere 50 includes seven dimple sections 54 that each include an identical dimple pattern inside the boundaries of the side edges 56 and base edge 58. As a result, the first hemisphere 50 of the golf ball 48 has seven-fold rotational symmetry (also referred to as axial symmetry) around a polar axis 60. In other words, the hemisphere 50 has an identical dimple pattern at seven different locations when the hemisphere 50 is rotated 2π/7 radians (approximately 51.43°) around the polar axis 60. The polar axis 60 is defined as the axis connecting the pole of the first hemisphere 50 to the pole of the second hemisphere 52.

The second hemisphere 52 also includes seven dimple sections 62. The hemisphere 52 may be the same as the hemisphere 50, only flipped to the opposite side of the spherical golf ball 48 such that the pole of the first hemisphere 50 and the pole of the second hemisphere 52 are poles of the golf ball 48, connected by the polar axis 60. The dimple sections 62 are bounded by side edges 64 and a base edge 66. In FIG. 6A, the dimple sections 54 are aligned with the dimple sections 62 such that the side edges 56 are collinear with the side edges 64 and the base edges 58 completely overlap the base edges 66. FIG. 6B is an alternative golf ball 48A in which hemispheres 50A, 52A include dimple sections 54A, 62A, respectively, which are the same as the hemispheres 50, 52 and dimple sections 54, 62, except that the hemisphere 52A is rotated around the polar axis 60 with respect to the hemisphere 50A. In the example of FIG. 6B, the hemisphere 52A is rotated 2π/14 radians (approximately 25.71°) around the polar axis 60 such that each side edge 56A or 64A bisects a base edge 58A or 66A of a dimple section on the opposite hemisphere. In other embodiments, the hemisphere 52 may be rotated any amount between 0 and 2π/7 radians with respect to the hemisphere 50.

Figure 6C:
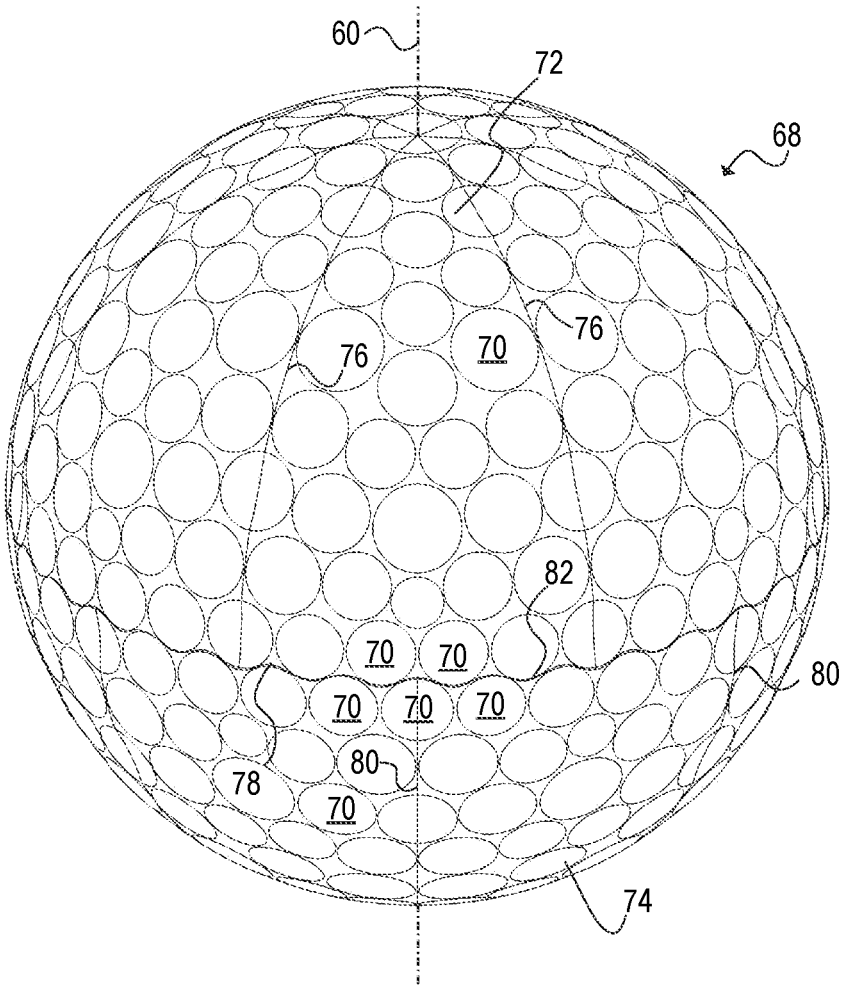
FIG. 6C illustrates a golf ball including a heptagonal dipyramid dimple pattern, according to a third embodiment.

As shown in FIGS. 6A and 6B, the parting line between the hemispheres of the golf balls 48, 48A may be flat. With a flat parting line, the base edges 66, 66A are linear (i.e., follow a straight path on the surface of the golf ball) and lie in and/or parallel to the equatorial plane. In other embodiments, a golf ball having a disclosed heptagonal dipyramid dimple pattern may include a staggered parting line. FIG. 6C is an example of a golf ball 68 having a plurality of dimples 70 arranged in a dimple pattern based on a heptagonal dipyramid and also having a staggered parting line. The dimples 70 are arranged in dimple sections 72, 74 that are similar to the dimple sections 54A, 62A of the golf ball 48A (dimple sections 72 in a first hemisphere, dimple sections 74 in a second hemisphere, with the second hemisphere being offset by 2π/14 radians). In particular, the dimple patterns within dimple sections 72, 74 are substantially identical to the dimple patterns within the dimple sections 54A, 62A of FIG. 6B. However, the golf ball 68 does not include any dimple-free great circles, including at the equator. The dimples 70 in dimple sections 72 that are adjacent to the equator of the golf ball 68 are interdigitated with dimples 70 in dimple sections 74 that are adjacent to the equator. In order to accommodate the interdigitated dimples 70, the dimple sections 72 are defined with linear side edges 76 and a curved base edge 78. For the purpose of this disclosure, the curved base edge 78 and other similar base edges disclosed herein, are considered "non-linear" base edges to differentiate from the "linear" side and base edges also disclosed herein. A "non-linear" base edge connects side edges to each other but does not follow a straight path on the surface. A "non-linear" base edge may have an "average" that is approximated by a straight path. For instance, the curved base edge 78 may have equal amplitudes above and below a line equivalent to a linear base edge. The dimple sections 74 similarly include linear side edges 80 and curved base edges 82. The side edges 76, 80 are similar to the side edges 56A, 64A extending longitudinally from a pole to the base edges 78, 82. The curved base edges 78, 82 follow a sinusoidal/wavy path between the dimples 70 that are adjacent to the equatorial plane. In this way, the dimples 70 are arranged in a dimple pattern that satisfies the criteria that the dimples 70 are either entirely within the boundaries of the dimple sections 72, 74 or have centroids on the side edges 76, 80 or at a pole of one of the hemispheres.

Figure 7A:
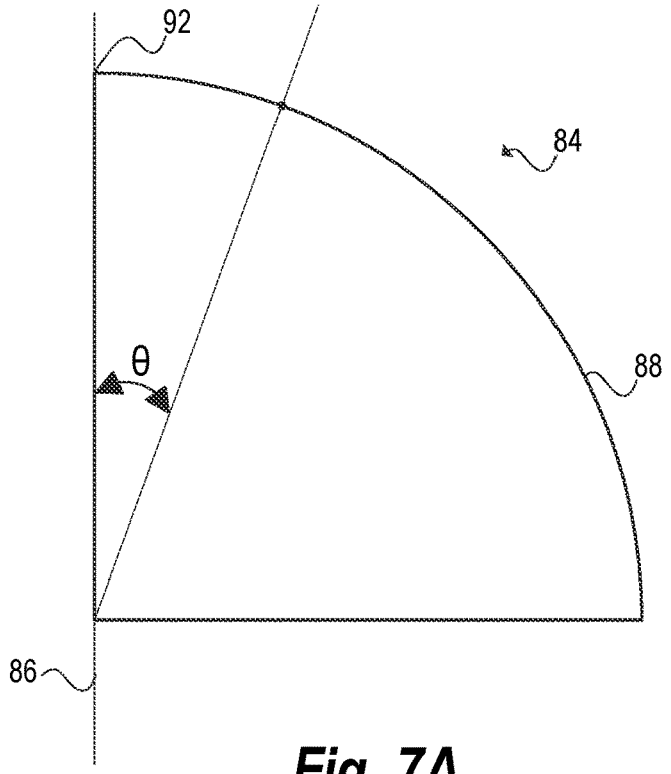
FIG. 7A is a side view of a segment of a heptagonal pyramid projected onto a hemisphere.
Figure 7B:
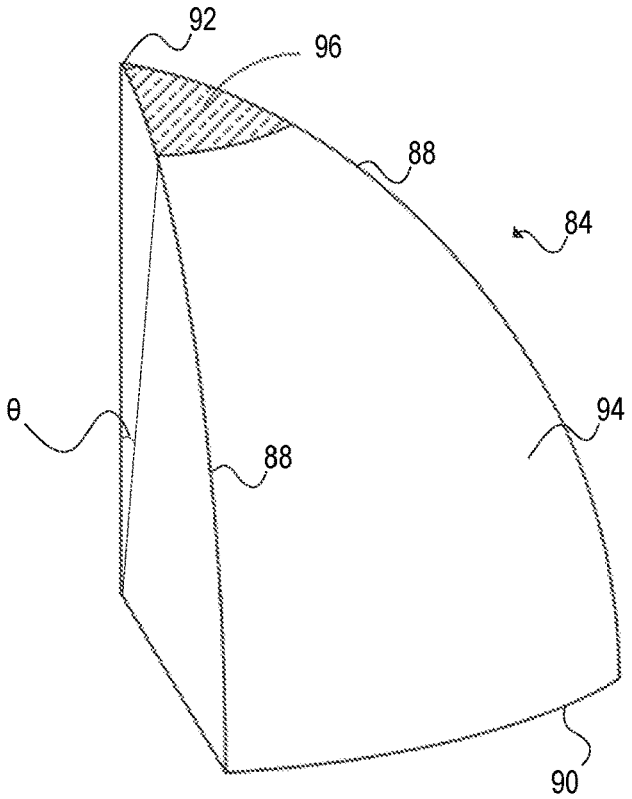
FIG. 7B is a perspective view of the segment shown in FIG. 7B.

FIGS. 7A and 7B are a side and perspective view of an exemplary section 84 of a sphere. The section 84 may correspond to a dimple section of a golf ball as described in the present disclosure, such as a section of a heptagonal dipyramid projected onto a sphere. The section 84 intersects a polar axis 86 and includes side edges 88 and a base edge 90. The polar axis 86 and side edges 88 intersect at a vertex 92 (which would be a pole of a complete hemisphere having seven of the sections 84 and/or a complete sphere having fourteen of the sections 84). The section 84 further includes a surface 94. The surface 94 is the surface of a complete sphere including the section 84 and include would include dimples in a golf ball having fourteen of the sections 84. One way to describe the location of a dimple on the surface 94 is by identifying the polar angle θ of the dimple. The polar angle θ of any dimple is the angle between the polar axis 86 and the dimple centroid. For example, a dimple having a centroid at the vertex 92 would have a polar angle θ of 0° and a dimple having a centroid on the base edge 90 would have a polar angle θ of 90°.

In some embodiments, the acceptable planar area of any one dimple on the surface 94 depends on its polar angle location. In some embodiments, the dependency on the polar angle may be limited to a particular surface area, such as a polar area 96. The polar area 96 may be, for example, an area from approximately 2° to 20° in polar angle. In an exemplary embodiment, the planar area of a dimple in the polar area 96 satisfies the following condition for a given polar angle x:

$$1.2\times10^{-4}x^2+2\times10^{-4}x\leq\text{planar area}\leq4.3\times10^{-4}x-7.5\times10^{-4}\text{Where } 2°\leq x\leq 20°$$

Figure 8:
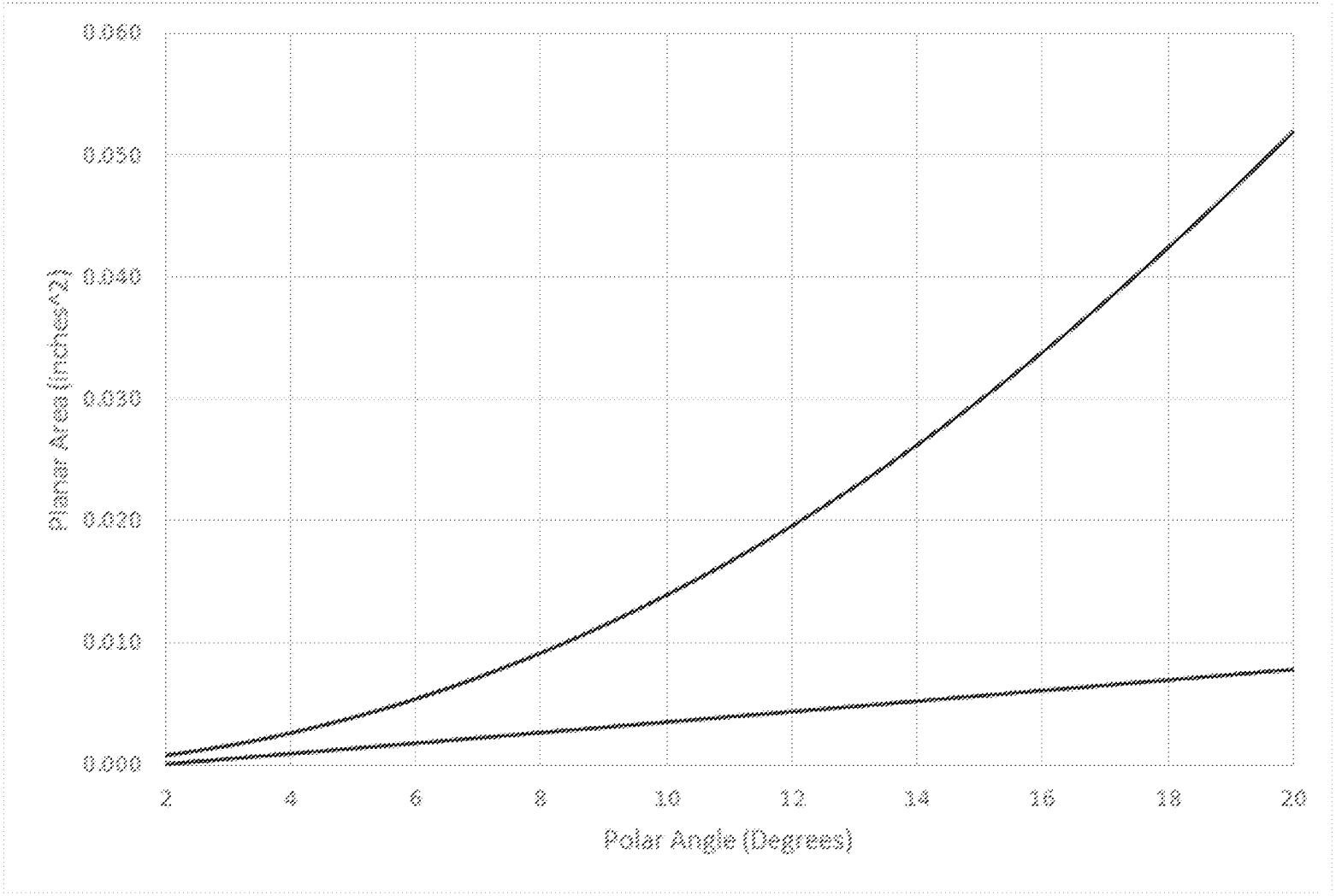
FIG. 8 is a graph of planar area to polar angle for some golf ball dimples, consistent with disclosed embodiments.

FIG. 8 includes a graph of planar area to polar angle for the above range. For dimples having centroids with a polar angle greater to or equal to 2° and less than or equal to 20°, the planar area falls on or between the lines shown in the graph. In an exemplary embodiment, any dimple outside of the 2-20° range has a planar area greater than or equal to 0.0018 $in^2$ and less than or equal to 0.052 $in^2$.

Figure 9A:
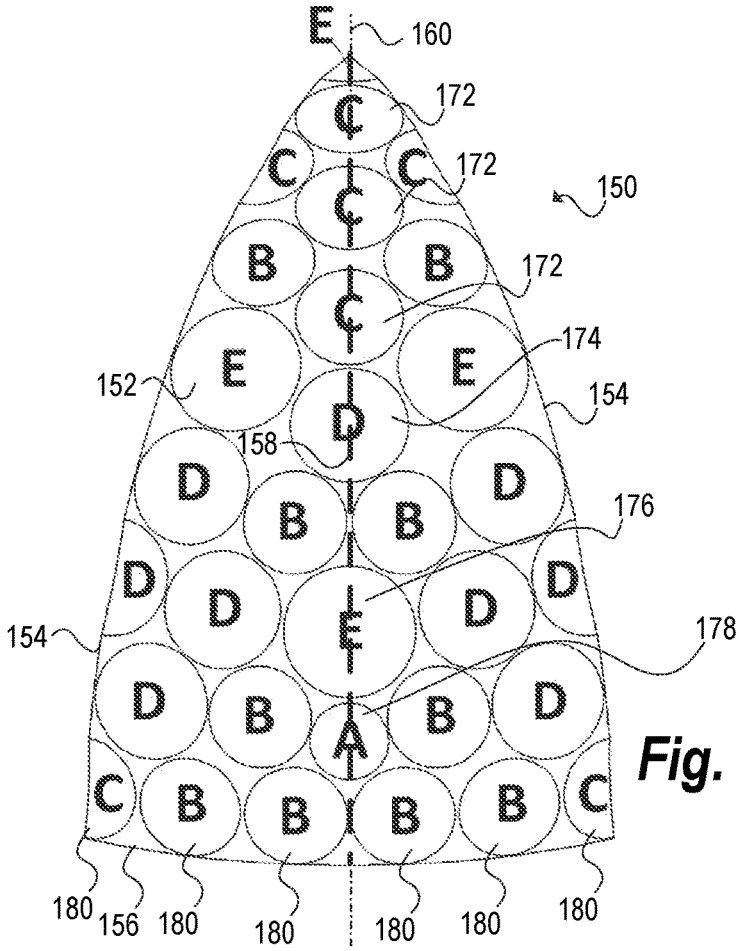
FIG. 9A illustrates an exemplary golf ball dimple section, based on the boundary line layout of FIG. 3A.

FIG. 9A shows a dimple section 150 including a subset of a plurality of dimples 152 formed on a surface. The dimple section 150 may correspond to the previously described dimple sections 34, 54. The dimple section 150 has two side edges 154 and a base edge 156. The dimples 152 are arranged within the dimple section 150 such that the pattern exhibits mirror symmetry across a symmetry line 158. As described above, the disclosed dimple pattern is arranged within the dimple sections such that, when repeated, the side edges that divide the dimple sections are interchangeable with the symmetry lines.

Figure 9B:
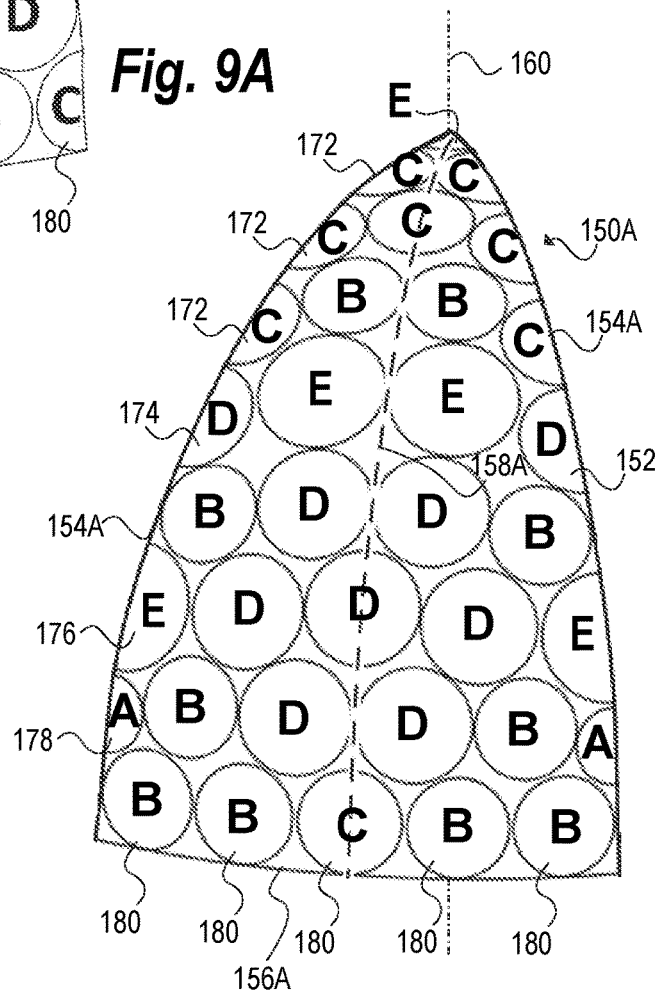
FIG. 9B illustrates another exemplary golf ball dimple section, based on the boundary line layout of FIG. 3B.

FIG. 9B shows a dimple section 150A including another subset of the plurality of dimples 152. The dimple section 150A corresponds to the previously described dimple section 34A. The dimple section 150A has two side edges 154A and a base edge 156A. A side edge 154A is equivalent to the symmetry line 158. The subset of dimples 152 are arranged within the dimple section 150A such that the pattern exhibits mirror symmetry across a symmetry line 158A. The symmetry line 158A is equivalent to the side edge 154. Repeating the dimple sections 150 and 150A seven times around a polar axis 160 results in identical hemispheres and dimple patterns (as mentioned, side and base edges described herein are not physically present on a disclosed golf ball). Thus, a description of a dimple 152 in relation to a side edge 154 could also be applied in relation to the symmetry line 158, and vice versa.

Figure 10:
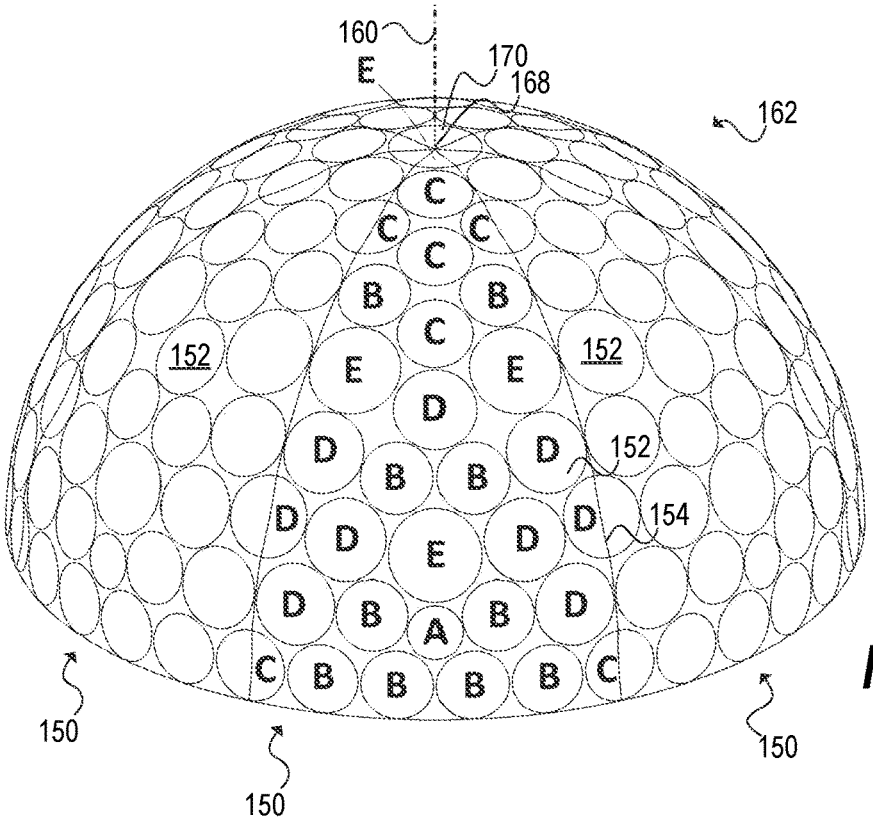
FIG. 10 illustrates a golf ball hemisphere having a dimple pattern and boundary line arrangement according to the embodiment shown in FIG. 9A.
Figure 11A:
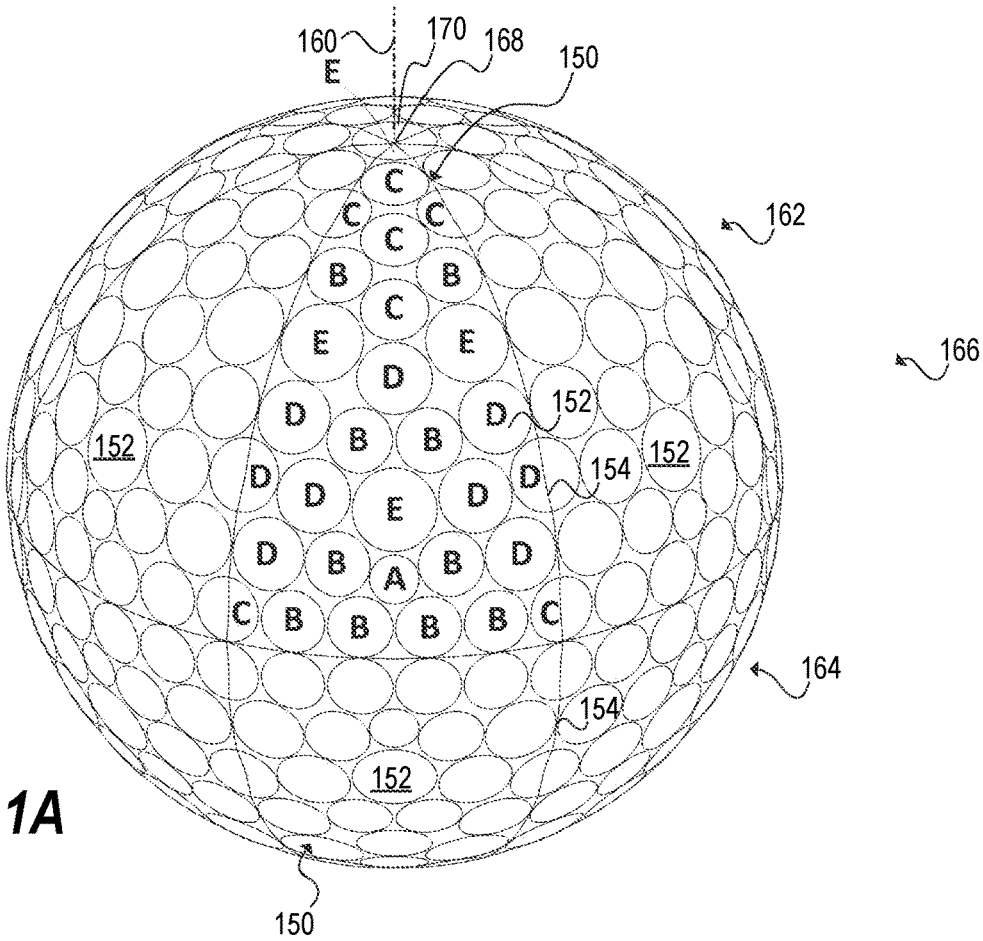
FIG. 11A illustrates a golf ball having a dimple pattern according to the embodiment shown in FIG. 9A and a planar parting line.

FIG. 10 shows the dimple section 150 of FIG. 9A with dimples 152 patterned around a hemisphere 162 that represents half of a golf ball. FIG. 11A shows the hemisphere 162 combined with an identical hemisphere 164 to form a golf ball 166. Each hemisphere 162, 164 includes seven dimple sections 150. The golf ball 166 includes fourteen substantially identical dimple sections 150. The golf ball 166 corresponds to the golf ball 48 in FIG. 6A, with the hemisphere 162 being a first hemisphere and the hemisphere 164 being a second hemisphere, joined at its base to the base of the first hemisphere 162. In FIG. 11A, the first hemisphere 162 is aligned with the second hemisphere 164. For example, the side edges 154 in the first hemisphere are continuous with side edges 154 of adjacent dimple sections in the second hemisphere 164.

The alphabetic labels placed within the dimples 152 in the figures designate same diameter dimples; i.e., all dimples labeled A have substantially the same diameter, all dimples labeled B have substantially the same diameter, and so on. In particular, the alphabetic labels within the dimples in the figures designate dimples 152 having the same dimple diameter, edge angle, and chord depth. In an exemplary embodiment, the number of different dimple diameters on the outer surface of a disclosed golf ball is five or less. In a further particular aspect of the embodiment illustrated in FIGS. 9A, 9B, 10, 11A, and 11B, the dimples 152 labeled A-E have the diameter, chord depth, and edge angle values given in Table 1 below:

| Dimple | Dimple Diameter (inches) | Edge Angle (Degrees) | Chord Depth (Inches) |
|---|---|---|---|
| A | 0.110 | 14.0° | 0.0049 |
| B | 0.145 | 14.0° | 0.0057 |
| C | 0.150 | 14.0° | 0.0058 |
| D | 0.165 | 14.0° | 0.0060 |
| E | 0.185 | 14.0° | 0.0062 |

Exemplary golf balls having dimples with properties according to Table 1 include five different dimple diameter sizes with a largest dimple diameter of 0.185 in. and a smallest dimple diameter of 0.110 in. The largest dimple diameter ratio is thus approximately 1.682, which is the dimple diameter ratio of the "A" and "E" dimples. The difference in diameter between the largest dimple diameter and the smallest dimple diameter is 0.075 in. The difference in chord depth between the smallest diameter dimple and the largest diameter dimple is 0.0013 in. In an exemplary embodiment, all of the dimples have the same edge angle. For example, the dimples "A"-"E" all have an edge angle of 14°.

In the golf ball 166, the linear side edges 154 intersect each other (i.e., create a vertex) at the pole 168 of the hemisphere 162. In an exemplary embodiment, the centroid of a polar dimple 170 is located at the pole 168, with a centroid of the polar dimple 170 at the vertex of the side edges 154. Each dimple section 150 thus includes a $1/7^{th}$ portion of the polar dimple 170. In an exemplary embodiment, the polar dimple 170 has a largest diameter of the dimple diameters present on the golf ball 166 (e.g., an "E" dimple). For example, the polar dimple 170 has a diameter of approximately 0.185 in.

In an exemplary embodiment, the dimple section 150 includes mirror symmetry across the symmetry line 158. The symmetry line 158 extends from the intersection of the side edges 154 at the pole 168 to a midpoint of the base edge 156. In at least some embodiments, the dimple section 150 includes at least some dimples 152 that have centroids that lie on a side edge 154 and at least some dimples that have centroids that lie on the symmetry line 158. According to an exemplary embodiment, within a single dimple section 150 or 150A, there are at least three dimples 152 on each side edge 154 and at least three dimples 152 on the symmetry line 158 (i.e., at least three dimples 152 lie on a first side edge 154, at least three different dimples 152 lie on a second side edge 154, and at least three different dimples 152 lie on the symmetry line 158, for a total of at least nine dimples 152 lying on those lines combined). According to another aspect of the golf ball 166, within each dimple section 150 or 150A there are at least six dimples 152 on the symmetry line 158 (FIG. 9A) or at least six dimples 152 on both side edges 154A (FIG. 9B). According to another aspect of the golf ball 166, there are a total of at least twelve dimples 152 that lie on either a side edge 154, 154A or a symmetry line 158, 158A.

The dimples 152 include three dimples 172 that lie on the symmetry line 158 (or side edge 154A) and are closest to the polar dimple 170. The three dimples 172 are the same size and shape. For example, the three dimples 172 closest to the polar dimple 170 are "C" dimples (i.e., not the smallest or largest dimples in the dimple section 150). The dimples 152 further include a dimple 174, a dimple 176, and a dimple 178, all also having a centroid that lies on the symmetry line 158 (or side edge 154A). The dimple 174 may be a "D" dimple, the dimple 176 may be an "E" dimple, and the dimple 178 may be an "A" dimple. In this way, the dimples 172, 174, 176, and 178 that lie on the symmetry line 158 (or side edge 154A) include at least four different dimple sizes. In an exemplary embodiment, the "A" dimple 178 may be the closest of the dimples 172, 174, 176, and 178 to the base edge 156.

The dimple section 150 may include at least twenty-four dimples that lie entirely within the boundaries of the dimple section 150, including one "A" dimple, ten "B" dimples, three "C" dimples, seven "D" dimples, and three "E" dimples. The dimple section 150A may include at least twenty-one dimples that lie entirely within the boundaries of the dimple section 150A, including ten "B" dimples, two "C" dimples, seven "D" dimples, and two "E" dimples. The dimples 152 include five dimples 180 located adjacent to the base edge 156 (or 156A). The dimples 180 include two different dimple diameters. In the dimple section 150, the dimples 180 include four consecutive dimples that are the same size (e.g., "B" dimples). In the dimple section 150A, the dimples 180 include a dimple that also lies on the symmetry line 158A.

Figure 11B:
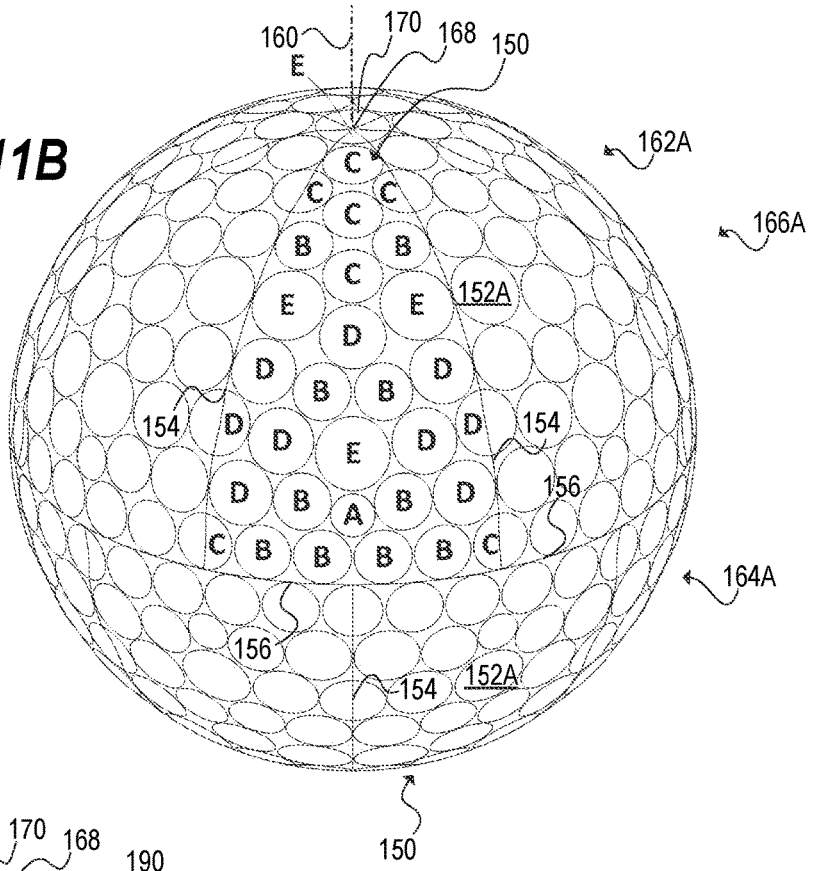
FIG. 11B illustrates another golf ball having a dimple pattern according to the embodiment shown in FIG. 9A, and offset sections across the equatorial plane.

FIG. 11B shows a golf ball 166A including dimples 152A, according to another embodiment. FIG. 11B corresponds to the golf ball 48A in FIG. 6B. The golf ball 166A includes dimple sections 150 formed in hemispheres 162A and 164A, which are identical to hemispheres 162, 164, except for their relative position. Each hemisphere 162A, 164A includes seven dimple sections 150, for a total of fourteen substantially identical dimple sections 150 in golf ball 166A. In the golf ball 166A, the hemisphere 162A is rotated by $2\pi/14$ radians with respect to the hemisphere 164A around the polar axis 160. As a result, the side edges 154 intersect the midpoint of an opposing base edge 156.

Figure 11C:
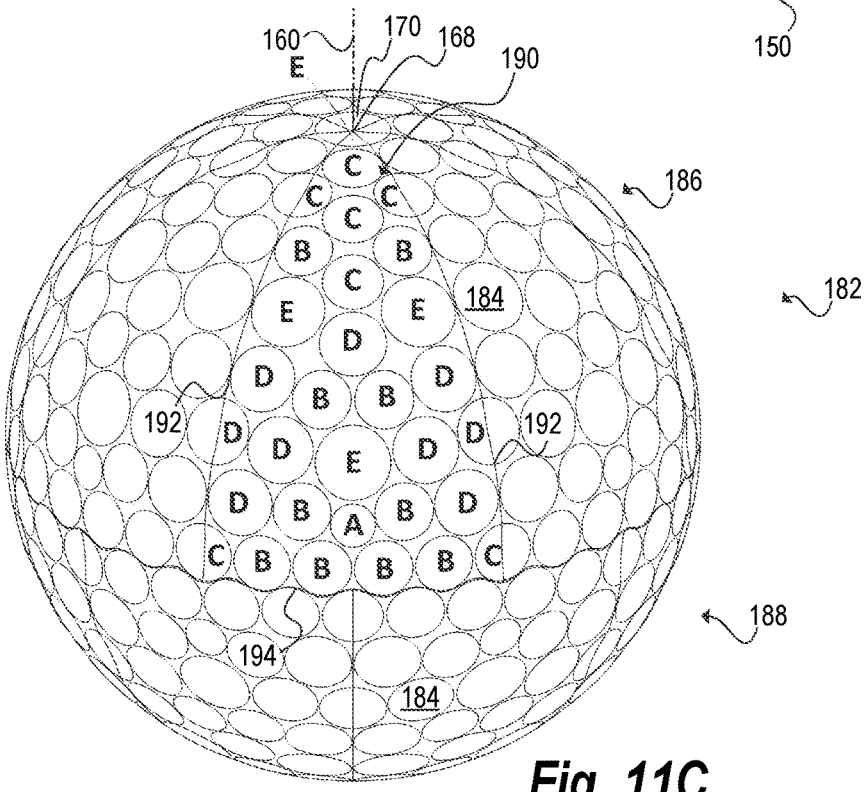
FIG. 11C illustrates another golf ball having a dimple pattern according to the embodiment shown in FIG. 9A, and a non-planar parting line.

FIG. 11C shows a golf ball 182 having dimples 184, according to another embodiment. FIG. 11C corresponds to the golf ball 68 in FIG. 6C. The golf ball 182 includes hemispheres 186 and 188, which are similar to the hemispheres 162A, 164A, except that the dimples 184 are adjusted (e.g., shifted in position) to produce a staggered parting line between the hemispheres 186, 188. The golf ball 182 includes a dimple section 190. The dimple section 190 is repeated seven times in the hemisphere 186 and seven times in the hemisphere 188 for a total of fourteen dimple sections in the golf ball 182. The dimples 184 in dimple section 190 include relative sizes that match the description of the section 150 (or 150A). The dimple section 190 includes linear side edges 192 and a curved base edge 194. In an exemplary embodiment, the above description of the dimples "A"-"E" may also apply to the golf ball 182.

The disclosed golf balls 166, 166A, and 182 each have an overall dimple pattern including a total of 380 dimples. The dimples produce a surface coverage of the outer surface of the golf ball of greater than 75%. In an exemplary embodiment, the dimples 152 provide a surface coverage of the outer surface of the golf ball of about 81.7%.

The disclosed embodiments include golf ball dimple patterns based on the projection of a heptagonal dipyramid. The disclosed features are exemplary and can be used individually or in combination with other design features to provide an aerodynamically tuned golf ball satisfying desired design characteristics.

When numerical lower limits and numerical upper limits are set forth herein, it is contemplated that any combination of these values may be used. All patents, publications, test procedures, and other references cited herein, including priority documents, are fully incorporated by reference to the extent such disclosure is not inconsistent with this invention and for all jurisdictions in which such incorporation is permitted.

While the illustrative embodiments of the invention have been described with particularity, it will be understood that various other modifications will be apparent to and can be readily made by those of ordinary skill in the art without departing from the spirit and scope of the invention. Accordingly, it is not intended that the scope of the claims appended hereto be limited to the examples and descriptions set forth herein, but rather that the claims be construed as encompassing all of the features of patentable novelty which reside in the present invention, including all features which would be treated as equivalents thereof by those of ordinary skill in the art to which the invention pertains.

What is claimed is:

1. A golf ball comprising a spherical surface and a plurality of dimples formed on the surface, wherein the dimples are arranged in a dimple pattern defined by a heptagonal dipyramid projected onto the surface, the pattern comprising fourteen substantially identical dimple sections including seven dimple sections in a first hemisphere and seven dimple sections in a second hemisphere, wherein a boundary of each of the dimple sections consists of two linear side edges and a linear or non-linear base edge, wherein the dimple pattern within each dimple section has mirror symmetry across a symmetry line that extends from an intersection of the two side edges to a midpoint of the base edge, wherein the centroids of at least six non-polar dimples lie on either (i) every symmetry line of every dimple section, or (ii) every side edge of every dimple section, and wherein the at least six non-polar dimples comprise three dimples that lie closest to a vertex of the side edges, and wherein the three dimples all have the same dimple diameter.

2. The golf ball of claim 1, wherein dimples comprising a centroid having a polar angle of greater than or equal to 2° and less than or equal to 20° have a planar area ($in^2$) satisfying the following condition for a given polar angle x of the dimple centroid:

$$1.2\times10^{-4}x^2+2\times10^{-4}x\leq\text{planar area}\leq4.3\times10^{-4}x-7.5\times10^{-4}\text{ where }2°\leq x\leq20°.$$

3. The golf ball of claim 1, wherein the dimple pattern comprises 370-390 dimples and provides surface coverage greater than 75% on the outer surface of the golf ball.

4. The golf ball of claim 1, wherein the side edges are defined such that each dimple section consists of a plurality of shared non-polar dimples each of which has a centroid that lies along a side edge of the dimple section, a plurality of dimples that are not intersected by a side edge, and, optionally, a shared polar dimple having a centroid that lies at the vertex of the two linear side edges of the section.

5. The golf ball of claim 1, wherein the centroids of at least three dimples lie on each side edge of each dimple section.

6. The golf ball of claim 1, wherein the at least six non-polar dimples comprise at least four different dimple diameters.

7. The golf ball of claim 1, wherein the at least six non-polar dimples comprise one dimple that lies closest to the base edge, and wherein the one dimple has the smallest diameter of all of the dimples in the dimple section.

8. The golf ball of claim 1, wherein the dimples within each dimple section that are located adjacent to the base edge of the section have diameters that are different by 0.005 inches or less.

9. The golf ball of claim 1, wherein the plurality of dimples comprise a largest dimple diameter of 0.185 in. and a smallest dimple diameter of 0.110 in.

10. The golf ball of claim 1, wherein each dimple has a diameter of 0.110 inches or greater.

11. The golf ball of claim 1, wherein each of the dimple sections comprises at least five different dimple diameters.

12. The golf ball of claim 1, wherein the dimple sections of the first hemisphere are aligned with the dimple sections of the second hemisphere.

13. The golf ball of claim 1, wherein the dimple sections of the first hemisphere are rotated with respect to the dimple sections of the second hemisphere about an axis through the poles of the first and second hemispheres.

14. The golf ball of claim 13, wherein the dimple sections of the first hemisphere are rotated $2\pi/14$ radians about the axis with respect to the dimple sections of the second hemisphere.

15. The golf ball of claim 1, wherein some of the dimples of the first hemisphere are interdigitated with some of the dimples of the second hemisphere to produce a staggered parting line.

16. A golf ball comprising a spherical surface and a plurality of dimples formed on the surface, wherein the dimples are arranged in a dimple pattern defined by a heptagonal dipyramid projected onto the surface, the pattern comprising fourteen substantially identical dimple sections including seven dimple sections in a first hemisphere and seven dimple sections in a second hemisphere, wherein a boundary of each of the dimple sections consists of two linear side edges and a linear or non-linear base edge, wherein the side edges are defined such that each dimple section consists of a plurality of shared non-polar dimples each of which has a centroid that lies along a side edge of the dimple section, a plurality of dimples that are not intersected by a side edge, and, optionally, a shared polar dimple having a centroid that lies at the vertex of the two linear side edges of the section, wherein the dimple pattern within each dimple section has mirror symmetry across a symmetry line that extends from an intersection of the two side edges to a midpoint of the base edge, wherein the centroids of at least six non-polar dimples lie on either (i) every symmetry line of every dimple section, or (ii) every side edge of every dimple section, and wherein the at least six non-polar dimples comprise three dimples that lie closest to a vertex of the side edges, and wherein the three dimples all have the same dimple diameter, wherein each dimple has a diameter of 0.110 inches or greater, wherein the dimple sections comprises at least five different dimple diameters, and wherein dimples comprising a centroid having a polar angle of greater than or equal to 2° and less than or equal to 20° have a planar area ($in^2$) satisfying the following condition for a given polar angle x of the dimple centroid:

$$1.2\times10^{-4}x^2+2\times10^{-4}x\leq\text{planar area}\leq4.3\times10^{-4}x-7.5\times10^{-4}\text{ where }2°\leq x\leq20°.$$

* * * * *